US010297966B1

(12) United States Patent
Hamner et al.

(10) Patent No.: US 10,297,966 B1
(45) Date of Patent: May 21, 2019

(54) MATING ADAPTER FOR AN ELECTRICAL CONNECTOR ASSEMBLY

(71) Applicant: TE CONNECTIVITY CORPORATION, Berwyn, PA (US)

(72) Inventors: Richard Elof Hamner, Hummelstown, PA (US); Christopher David Ritter, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/871,207

(22) Filed: Jan. 15, 2018

(51) Int. Cl.
*H01R 13/648* (2006.01)
*H01R 31/06* (2006.01)
*H01R 13/6591* (2011.01)

(52) U.S. Cl.
CPC ..... *H01R 31/06* (2013.01); *H01R 13/6591* (2013.01)

(58) Field of Classification Search
CPC ..... H01R 13/6591; H01R 31/06
USPC ..... 439/607.1, 607.05, 74, 354, 638
See application file for complete search history.

(56) References Cited

U.S. PATENT DOCUMENTS 4,173,387 A * 11/1979 Zell ..... H01R 12/7029 439/557
4,664,462 A * 5/1987 Owens ..... H01R 13/516 439/378
4,787,860 A * 11/1988 Bender ..... H01R 13/6275 439/358
4,867,690 A * 9/1989 Thumma ..... H01R 12/727 439/79
4,923,405 A * 5/1990 Munsterman ..... H01R 12/58 439/161
4,973,268 A * 11/1990 Smith ..... H01R 13/4365 439/589
4,979,915 A * 12/1990 Pitts ..... H01R 13/04 439/595
5,286,212 A * 2/1994 Broeksteeg ..... H01R 12/716 439/108
5,417,590 A * 5/1995 Dechelette ..... H01R 13/64 439/607.48
5,554,050 A * 9/1996 Marpoe, Jr. ..... H01R 13/7195 333/181
5,582,519 A * 12/1996 Buchter ..... H01R 13/652 439/101
5,593,309 A * 1/1997 Post ..... H01R 13/62905 439/157
5,816,861 A * 10/1998 Cheng ..... H01R 13/631 439/653

(Continued)

*Primary Examiner* — Abdullah A Riyami
*Assistant Examiner* — Vladimir Imas

(57) ABSTRACT

An electrical connector assembly includes a header connector having a header housing with a cavity and header signal and ground contacts held in the header housing. The assembly includes a mating adapter having first and second mating ends and an adapter housing holding adapter signal and ground contacts. The adapter signal contacts have receptacles. The first mating end and the second mating end are configured to be selectively received in the cavity of the header housing. The first receptacles are mated to corresponding mating pins of the deader signal contacts when the first mating end is received in the cavity and the second receptacles are mated to corresponding mating pins when the second mating end is received in the cavity.

20 Claims, 10 Drawing Sheets

(56) References Cited

U.S. PATENT DOCUMENTS 6,561,821 B1 * 5/2003 Yu ..... H01R 9/096 439/591
6,695,622 B2 * 2/2004 Korsunsky ..... H01R 31/06 439/631
6,918,774 B2 * 7/2005 Wu ..... H01R 31/06 439/65
7,104,808 B2 * 9/2006 Korsunsky ..... H01R 13/113 439/76.1
7,338,291 B2 * 3/2008 Takada ..... H01R 13/6315 439/65
7,407,387 B2 * 8/2008 Johnescu ..... H01R 13/506 439/70
7,410,368 B2 * 8/2008 Lappoehn ..... H01R 31/06 439/76.1
7,425,137 B1 * 9/2008 Sipe ..... H01R 13/514 439/65
7,445,467 B1 * 11/2008 Matsuo ..... H01R 13/514 439/637
7,520,756 B2 * 4/2009 Nagata ..... H01R 13/41 439/74
7,985,079 B1 * 7/2011 Wilson ..... H01R 12/52 439/74
8,105,114 B2 * 1/2012 Kagotani ..... H01R 12/716 439/639
8,360,789 B2 * 1/2013 Yin ..... H01R 12/52 439/66
8,425,236 B2 * 4/2013 Cipolla ..... H01R 12/716 439/59
8,485,831 B2 * 7/2013 Cipolla ..... H01R 13/6587 439/607.07
8,721,350 B2 * 5/2014 Liu ..... H01R 13/6315 439/65
8,827,746 B2 * 9/2014 Lemke ..... H01R 13/6471 361/788
8,992,252 B2 3/2015 McClellan et al.
9,184,523 B2 * 11/2015 Tamai ..... H01R 31/06
9,385,458 B2 * 7/2016 Jeon ..... H01R 13/6587
9,478,889 B2 * 10/2016 Oshida ..... H01R 13/42
9,531,133 B1 * 12/2016 Horning ..... H01R 13/6477
9,608,382 B2 3/2017 McClellan et al.
9,666,991 B2 5/2017 Davis
9,812,817 B1 * 11/2017 Shirai ..... H01R 13/6589
9,859,635 B1 * 1/2018 Pickel ..... H01R 12/716
2002/0142631 A1 * 10/2002 Chang ..... H01R 12/7082 439/78
2003/0119362 A1 * 6/2003 Nelson ..... H01R 13/518 439/607.07
2010/0184307 A1 * 7/2010 Arai ..... H04M 1/76 439/65
2012/0295453 A1 * 11/2012 Cipolla ..... H01R 12/716 439/67
2013/0164955 A1 * 6/2013 Tamai ..... H01R 13/6469 439/76.1
2015/0079814 A1 * 3/2015 Tamai ..... H01R 12/91 439/55
2015/0079819 A1 * 3/2015 Tamai ..... H01R 12/7082 439/101
2015/0236450 A1 * 8/2015 Davis ..... H01R 13/6581 439/78
2016/0118751 A1 * 4/2016 McClellan ..... H01R 13/6587 439/607.08

* cited by examiner

MATING ADAPTER FOR AN ELECTRICAL CONNECTOR ASSEMBLY

BACKGROUND OF THE INVENTION

The subject matter herein relates generally to a mating adapter for an electrical connector assembly.

Electrical connector assemblies utilize electrical connectors to electrically connect various components of the system. For example, in some systems, two circuit boards are electrically connected using electrical connectors mounted to each circuit board. Typically, one electrical connector is a header connector having male contacts and the other electrical connector is a receptacle connector having female contacts. The header connector and the receptacle connector are directly mated together to connect the circuit boards. Other systems utilize cable assemblies between electrical connectors to electrically connect the components. For example, some systems utilize a cable assembly having cable connectors provided at opposite ends of one or more cables that are mated with board connectors mounted to two different circuit boards. The cables allow routing of the cable assembly between the circuit boards. Typically, the board connectors are receptacle connectors having female contacts and the cable connectors are header connectors having male contacts. The cable connectors are directly mated with corresponding board connectors.

However, known electrical systems are not without disadvantages. For instance, when two system components are to be connected without having complementary mating connectors, one of the connectors needs to be removed and replaced with a different type of mating connector. For instance, when two circuit boards are to be connected but both circuit boards have header connectors with male contacts, the components are unable to be mated without removing one of the connectors and replacing such connector with a receptacle connector. Similarly, when a cable header connector is provided and desired to be electrically connected to a board header connector, one of the connectors would need to be replaced with a receptacle type connector, which may require costly replacement. There is potential for damage to the system components during the removal and replacement. The removal and replacement process is time consuming.

A need remains for an electrical connector assembly capable of modification for design flexibility and elimination of costly rework and replacement.

BRIEF DESCRIPTION OF THE INVENTION

In one embodiment, an electrical connector assembly is provided including a header connector having a header housing including shroud walls defining a cavity. The header housing has a mating end and a terminating end and a latching feature. The header connector includes header signal contacts held in the header housing and header ground contacts held in the header housing providing electrical shielding for corresponding header signal contacts. The header signal contacts have mating pins at mating ends thereof. The electrical connector assembly includes a mating adapter having a first mating end and a second mating end. The mating adapter has an adapter housing holding adapter signal contacts and adapter ground contacts providing electrical shielding for corresponding adapter signal contacts. The adapter signal contacts have first receptacles at first ends thereof and second receptacles at second ends thereof. The mating adapter has a latching feature configured to be latchably coupled to the latching feature of the header housing to secure the mating adapter in the cavity of the header housing. The first mating end and the second mating end are configured to be selectively received in the cavity of the header housing. The first receptacles are mated to the corresponding mating pins when the first mating end is received in the cavity of the header housing and the second receptacles are mated to the corresponding mating pins when the second mating end is received in the cavity of the second header housing.

In another embodiment, a mating adapter is provided for a header connector of an electrical connector assembly that includes contact modules arranged in a contact module stack and extending between a first mating end and a second mating end. Each contact module has a contact holder holding adapter signal contacts and adapter ground contacts. The adapter signal contacts have first receptacles at the first mating end and second receptacles at the second mating end for mating with header signal contacts of the header connector. The adapter ground contacts include first mating beams at the first mating end and second mating beams at the second mating end for mating with header ground contacts of the header connector. The mating adapter includes a first receptacle housing having walls extending between a front and a rear of the first receptacle housing. The first receptacle housing has pockets at the rear receiving the first mating ends of corresponding contact modules. The first receptacle housing has signal channels at the front receiving corresponding first receptacles and the first receptacle housing has ground channels at the front receiving corresponding first mating beams. The mating adapter includes a second receptacle housing having walls extending between a front and a rear of the second receptacle housing. The second receptacle housing has pockets at the rear receiving the second mating ends of corresponding contact modules. The second receptacle housing has signal channels at the front receiving corresponding second receptacles and the second receptacle housing has ground channels at the front receiving corresponding second mating beams. The first receptacle housing and the second receptacle housing are configured to be selectively received in the cavity of the header housing for mating the adapter signal contacts and the adapter ground contacts with the header signal contacts and the header ground contacts.

In another embodiment, an electrical connector assembly is provided including a first header connector, a second header connector and a mating adapter. The first header connector includes a first header housing including shroud walls defining a cavity. The first header housing has a first mating end and a first terminating end. The first header housing has a first latching feature. The first header connector includes first header signal contacts held in the first header housing and first header ground contacts held in the first header housing providing electrical shielding for corresponding first header signal contacts. The first header signal contacts have mating pins at mating ends thereof. The first header signal contacts and the first header ground contacts define a first mating interface. The second header connector has a second header housing including shroud walls defining a cavity. The second header housing has a second mating end and a second terminating end. The second header housing has a second latching feature. The second header connector includes second header signal contacts held in the second header housing and second header ground contacts held in the second header housing providing electrical shielding for corresponding second header signal contacts. The second header signal contacts have mating pins at mating ends thereof. The second header signal contacts and the second header ground contacts define a second mating interface. The mating adapter has a first mating end and a second mating end. The mating adapter has an adapter housing holding adapter signal contacts and adapter ground contacts providing electrical shielding for corresponding adapter signal contacts. The adapter signal contacts have first receptacles at first ends thereof and second receptacles at second ends thereof. The mating adapter has an adapter latching feature. The first mating end and the second mating end are interchangeable. The first mating end is received in the cavity of the first header housing such that the first receptacles are mated to the corresponding mating pins of the first header signal contacts and the adapter ground contacts are mated to the corresponding first header ground contacts. The second mating end is received in the cavity of the second header housing such that the second receptacles are mated to the corresponding mating pins of the second header signal contacts and the adapter ground contacts are mated to the corresponding second header ground contacts.

DETAILED DESCRIPTION OF THE INVENTION

Figure 1:
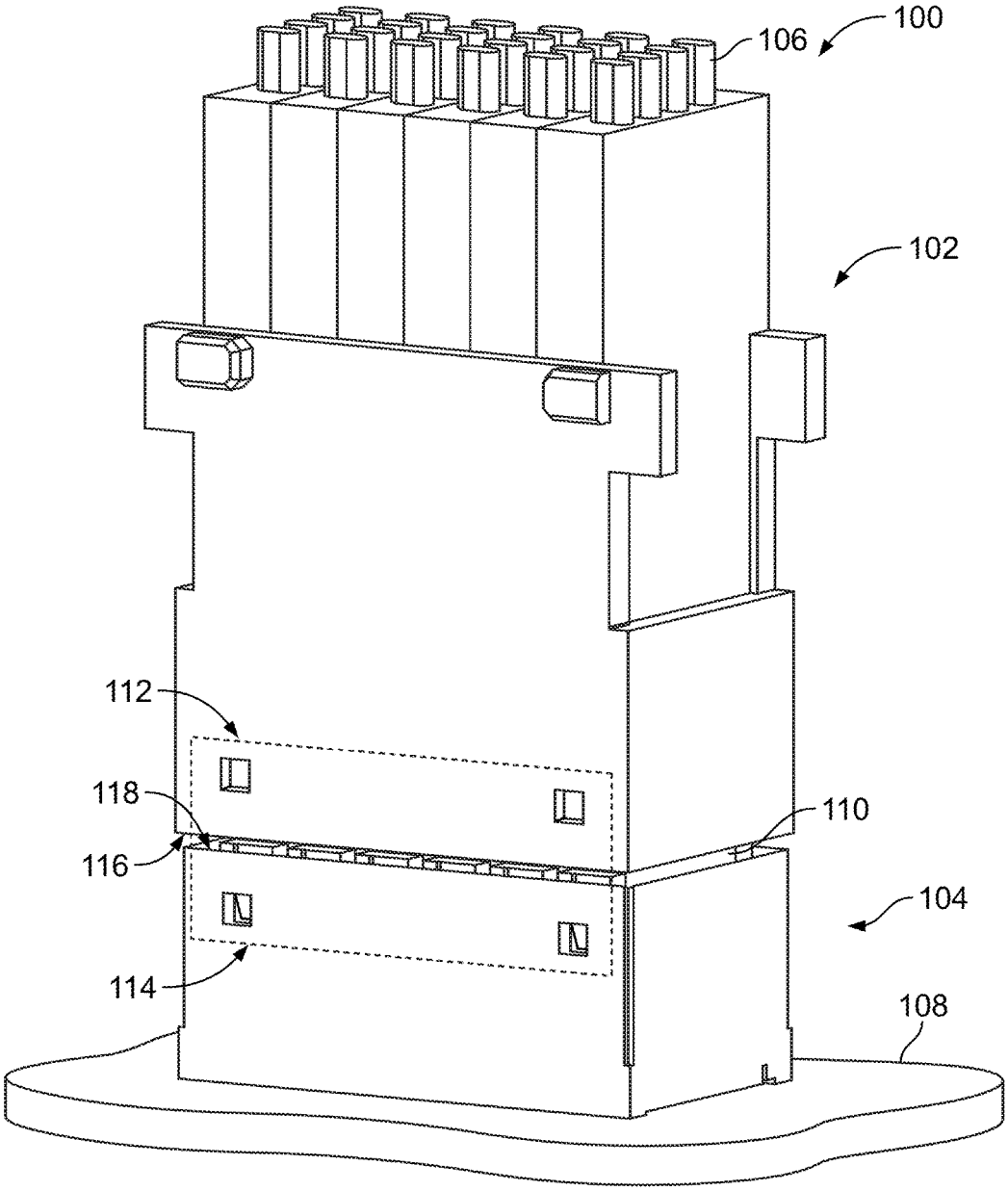
FIG. 1 is a perspective view of an electrical connector assembly formed in accordance with an exemplary embodiment.
Figure 2:
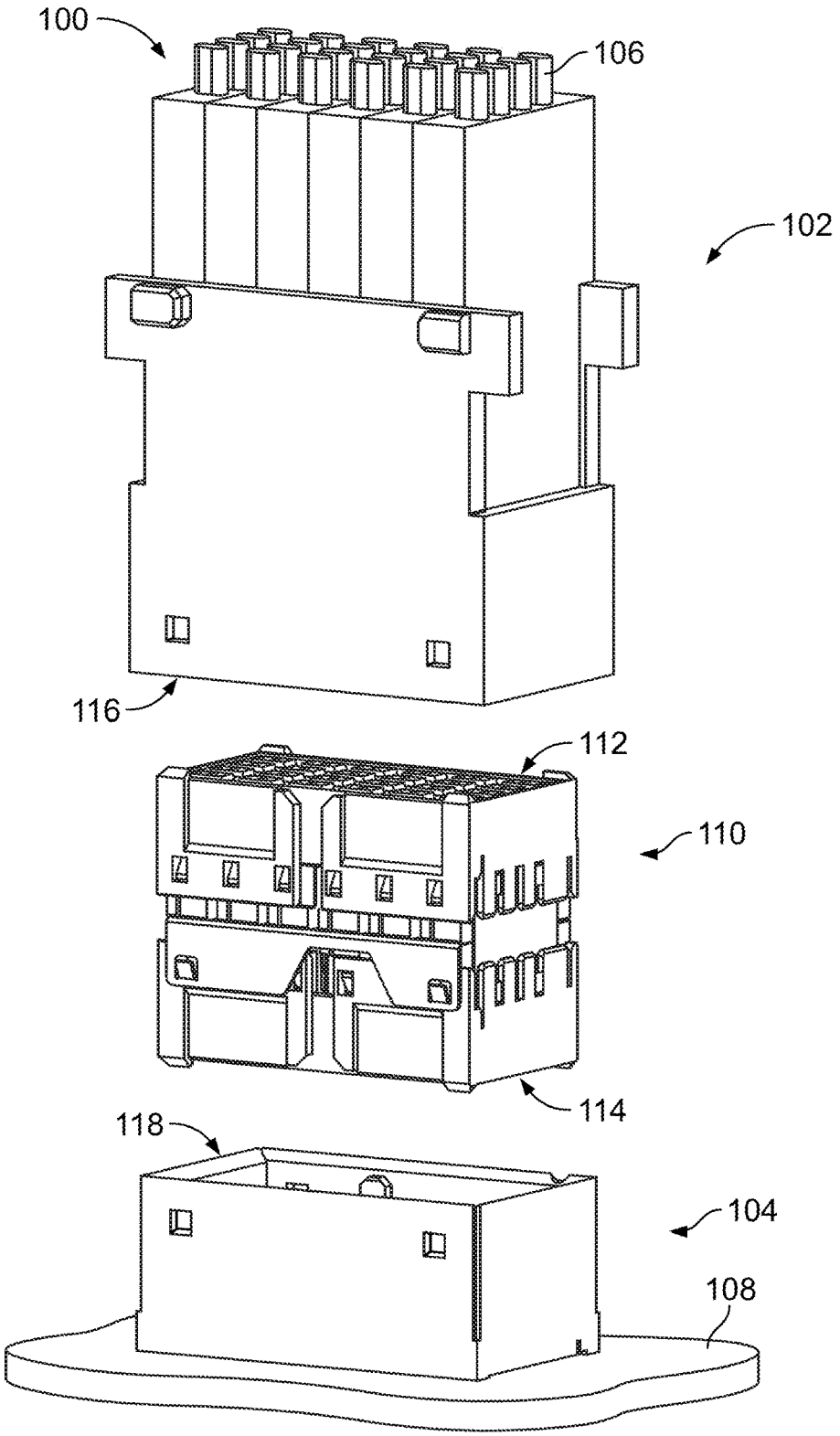
FIG. 2 is an exploded view of the electrical connector assembly in accordance with an exemplary embodiment.

FIG. 1 is a perspective view of an electrical connector assembly 100 formed in accordance with an exemplary embodiment. FIG. 2 is an exploded view of the electrical connector assembly 100 in accordance with an exemplary embodiment. The electrical connector assembly 100 includes a first header connector 102, a second header connector 104 and a mating adapter 110 used to electrically couple the first header connector 102 and the second header connector 104. In the illustrated embodiment, the first header connector 102 is a cable header connector having cables 106 extending from the first header connector 102. In the illustrated embodiment, the second header connector 104 is a board header connector configured to be mounted to a printed circuit board 108. However, in alternative embodiments, both header connectors 102, 104 may be cable header connectors or both header connectors 102, 104 may be board header connectors.

The mating adapter 110 may be semi-permanently coupled to one of the header connectors, such as the first header connector 102 or the second header connector 104, and then separably coupled to the other header connector, such as the other of the first header connector 102 or the second header connector 104. In an exemplary embodiment, the mating adapter 110 is reversible such that the mating adapter 110 may be selectively coupled to the first and second header connectors 102, 104 in a first orientation or in a second orientation. For example, in the first orientation, the mating adapter 110 is latchably coupled to the first header connector 102 and releasably coupled to the second header connector 104, whereas, in the second orientation, the mating adapter 110 is latchably coupled to the second header connector 104 and releasably coupled to the first header connector 102. FIG. 2 illustrates the mating adapter 110 in the second orientation configured to be semi-permanently coupled to the second header connector 104 and separably coupled to the first header connector 102. In other various embodiments, the mating adapter 110 may be semi-permanently coupled to both of the header connectors 102, 104. In other various embodiments, the mating adapter 110 may be separably coupled to both of the header connectors 102, 104.

The mating adapter 110 extends between a first mating end 112 and a second mating end 114. In an exemplary embodiment, the first and second mating ends 112, 114 are interchangeable to allow either mating end 112 or 114 to be coupled to either header connector 102 or 104. For example, the first and second mating ends 112, 114 may be identical in various embodiments. In alternative embodiments, rather than being identical, the first and second mating ends 112, 114 may be substantially similar in various aspects to be configured to be coupled to either of the header connectors 102, 104. In other various embodiments, the first and second mating ends 112, 114 may be different limiting connection of the first mating end 112 to the first header connector 102 and mating of the second mating end 114 to the second header connector 104.

The first header connector 102 includes a first mating interface 116 and the second header connector 104 includes a second mating interface 118. In an exemplary embodiment, the first and second mating interfaces 116, 118 may be identical to allow either mating end 112 or 114 to be coupled to either mating interface 116 or 118. In alternative embodiments, rather than being identical, the first and second mating interfaces 116, 118 may be substantially similar, and configured to be coupled to either mating end 112 or 114. In other various embodiments, the first and second mating interfaces 116, 118 may be different limiting connection of the first mating interface 116 to the first mating end 112 and mating of the second mating interface 118 to the second mating end 114.

Figure 3:
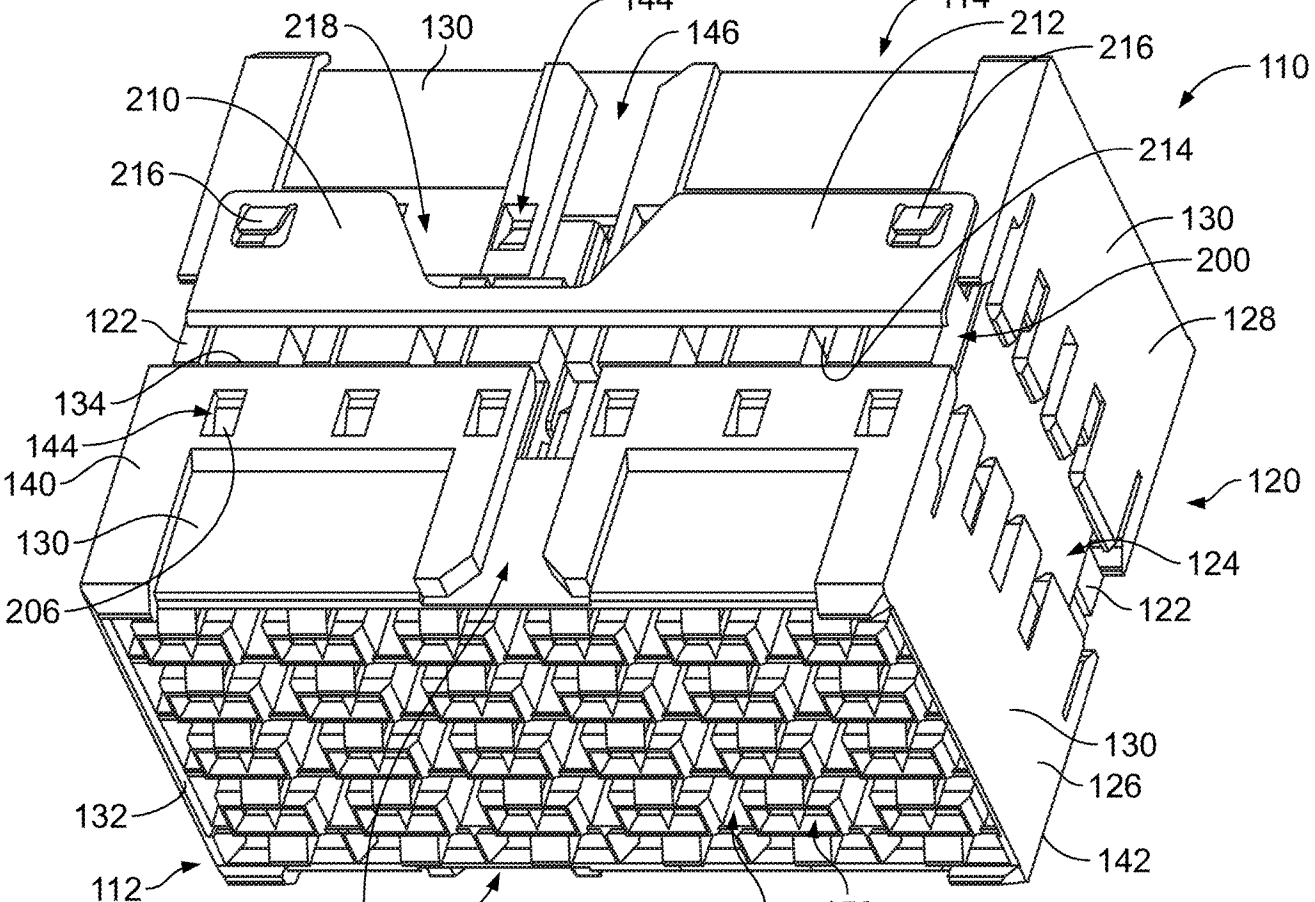
FIG. 3 is a perspective view of a mating adapter of the electrical connector assembly in accordance with an exemplary embodiment.
Figure 4:
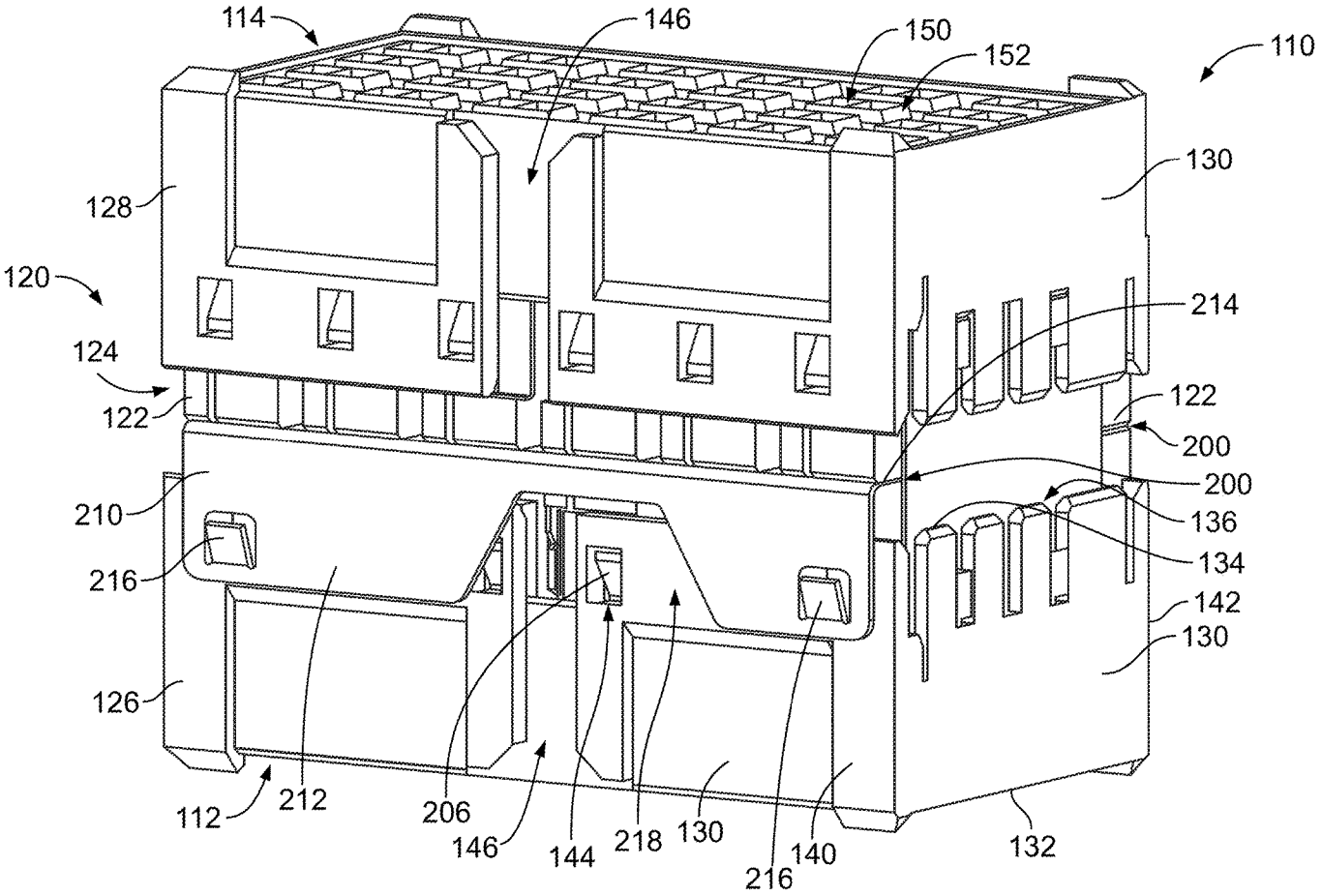
FIG. 4 is a perspective view of the mating adapter in accordance with an exemplary embodiment.
Figure 5:
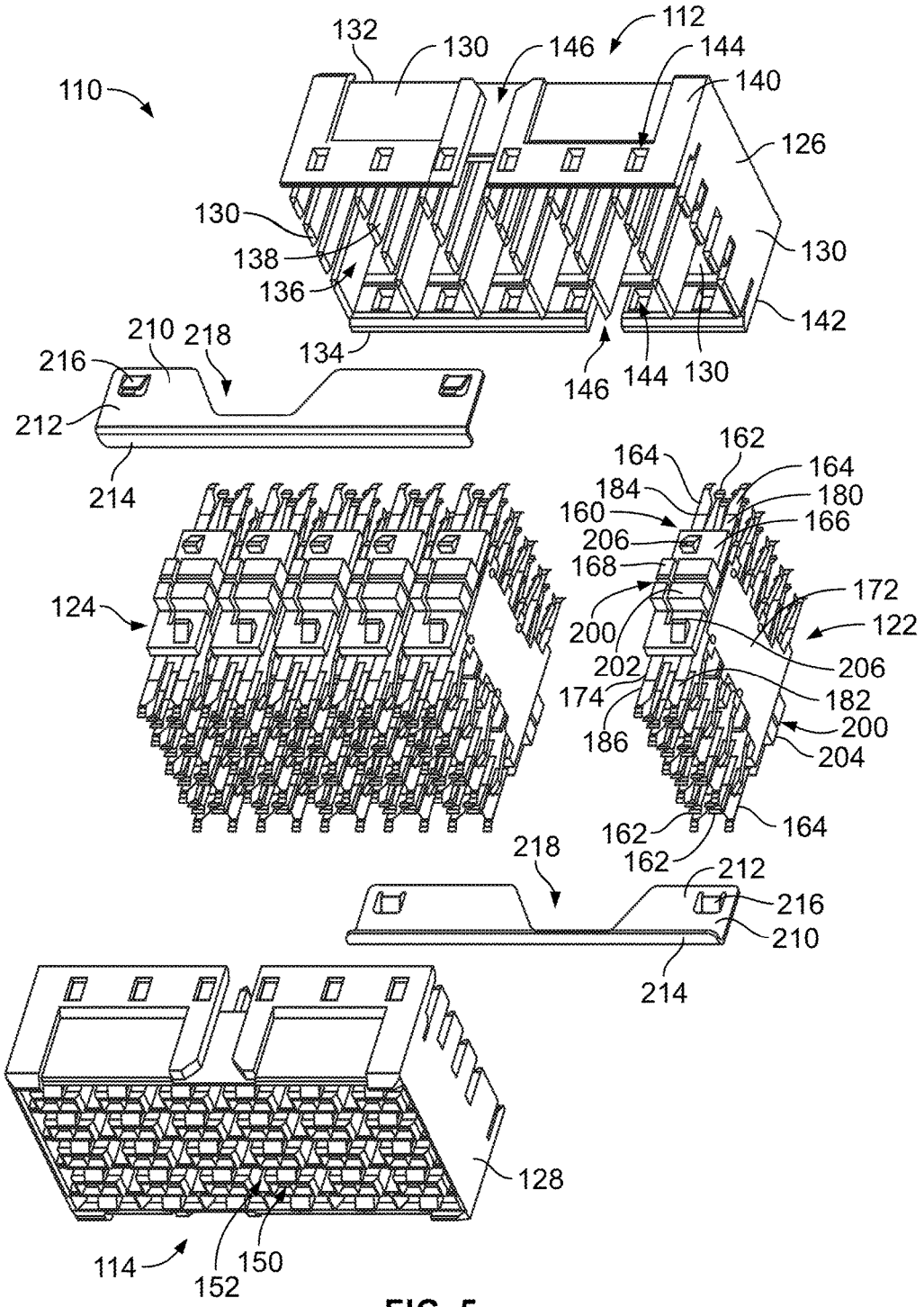
FIG. 5 is an exploded view of the mating adapter in accordance with an exemplary embodiment.

FIG. 3 is a perspective view of the mating adapter 110 in accordance with an exemplary embodiment illustrating the first mating end 112. FIG. 4 is a perspective view of the mating adapter 110 in accordance with an exemplary embodiment illustrating the second mating end 114. FIG. 5 is an exploded view of the mating adapter 110 in accordance with an exemplary embodiment.

The mating adapter 110 includes an adapter housing 120 holding a plurality of contact modules 122 arranged in a contact module stack 124. In an exemplary embodiment, the adapter housing 120 is a multi-piece housing formed from a first receptacle housing 126 and a second receptacle housing 128. The contact modules 122 are captured between the first and second receptacle housings 126, 128. Optionally, the first and second receptacle housings 126, 128 may be coupled together to form the adapter housing 120. Alternatively, as in the illustrated embodiment, the first receptacle housing 126 may be separate from the second receptacle housing 128 with the first and second receptacle housings 126, 128 being coupled together by the contact modules 122.

Optionally, the first and second receptacle housing 126, 128 may be identical. The description herein will be generally with reference to the first receptacle housing 126; however, the second receptacle housing 128 may include like features identified by like reference numbers. The receptacle housing 126 includes a plurality of walls 130 extending between a front 132 and a rear 134. The receptacle housing 126 includes pockets 136 at the rear 134 separated by divider walls 138 (shown, for example, in FIG. 5). In the illustrated embodiment, the divider walls 138 are arranged vertically between the wall 130 at a top 140 of the receptacle housing 126 and the wall 130 at a bottom 142 of the receptacle housing 126. Each pocket 136 is configured to receive a corresponding contact module 122 of the contact module stack 124. In an exemplary embodiment, the walls 130 of the receptacle housing 126 include openings 144 at the top 140 and bottom 142 configured to receive portions of the contact modules 122 to hold the contact modules 122 in the pockets 136. Other types of securing features may be provided to secure the contact modules 122 in the pockets 136.

In an exemplary embodiment, the receptacle housing 126 includes one or more keying features 146 at the top 140 and/or the bottom 142. For example, the keying features 146 at the top 140 and the bottom 142 may be offset to provide keyed mating with the first header connector 102 (shown in FIG. 1) and/or the second header connector 104 (shown in FIG. 1). In the illustrated embodiment, the keying features 146 are keying slots configured to engage corresponding keying features in the first header connector 102 and/or the second header connector 104 for orienting the mating adapter 110 relative to the first and second header connectors 102, 104. Other types of keying features 146 may be provided in alternative embodiments.

The receptacle housing 126 includes signal channels 150 in the front 132 configured to receive corresponding signal contacts. The receptacle housing 126 includes ground channels 152 in the front 132 configured to receive corresponding ground contacts. Optionally, the signal channels 150 may be arranged in pairs to receive pairs of signal contacts surrounded by corresponding ground channels 152 that receive corresponding ground contacts that provide electrical shielding around corresponding pairs of the signal contacts. Other arrangements are possible in alternative embodiments. In an exemplary embodiment, the signal channels 150 receive signal contacts from the contact modules 122 and are configured to receive signal contacts from the header connector 102 or 104. In an exemplary embodiment, the ground channels 152 received ground contacts from the contact modules 122 and are configured to receive ground contacts from the header connector 102 or 104.

Figure 6:
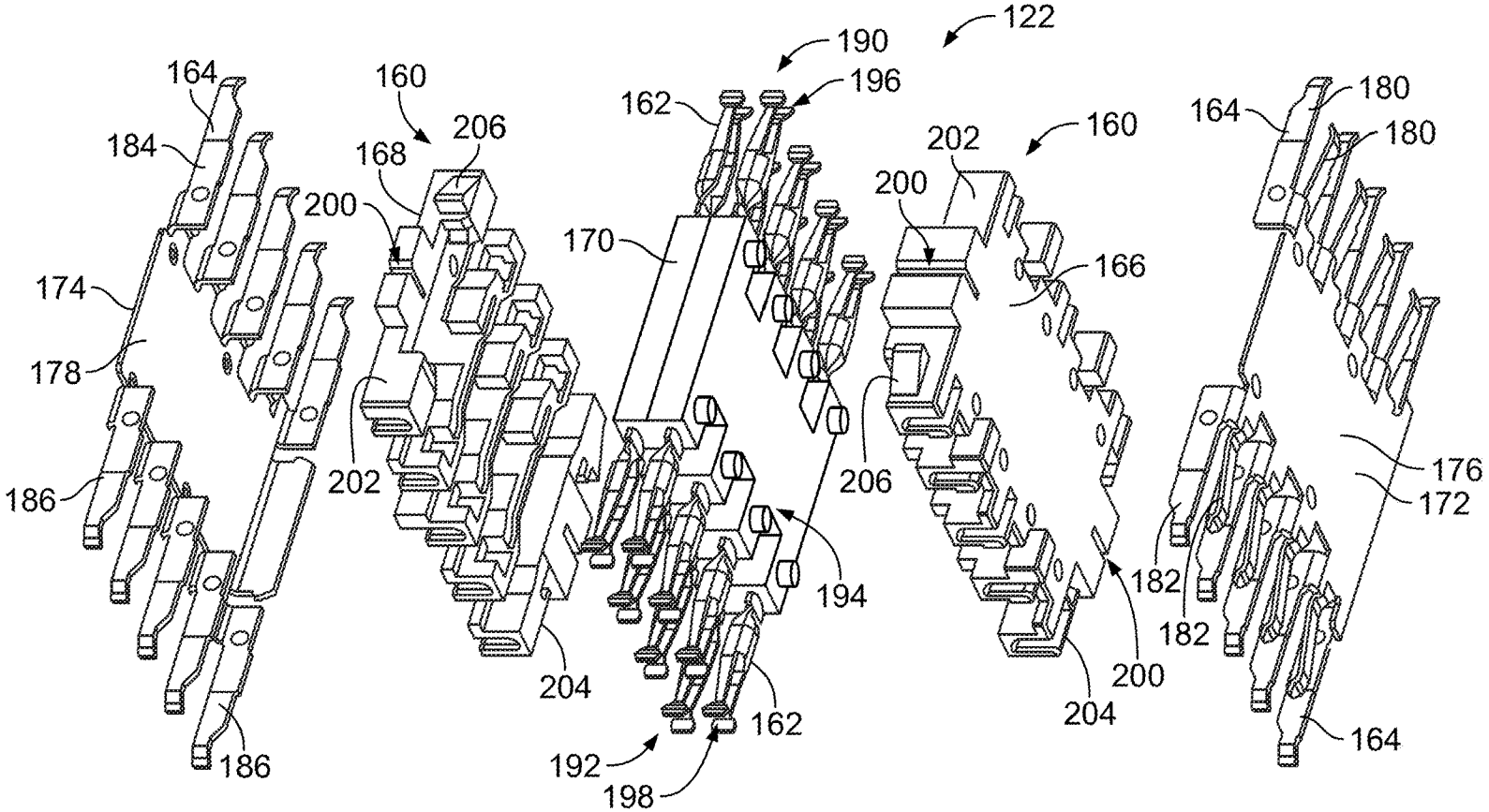
FIG. 6 is an exploded view of a contact module of the mating adapter in accordance with an exemplary embodiment.

FIG. 6 is an exploded view of one of the contact modules 122 in accordance with an exemplary embodiment. In an exemplary embodiment, the contact module 122 includes a contact holder 160 holding adapter signal contacts 162 and adapter ground contacts 164. In the illustrated embodiment, the contact holder 160 is a multi-piece holder including a first conductive shell 166, a second conductive shell 168 and a dielectric frame 170 received between the first and second conductive shells 166, 168. The dielectric frame 170 supports the adapter signal contacts 162. For example, the dielectric frame 170 may be overmolded on the adapter signal contacts 162. Alternatively, the adapter signal contacts 162 may be loaded into the dielectric frame 170 rather than being overmolded. In other various embodiments, the contact holder 160 may include multiple dielectric frames 170 holding different adapter signal contacts 162. The first and second conductive shells 166, 168 provide electrical shielding for the adapter signal contacts 162. Optionally, the conductive shells 166, 168 may be plated plastic shells. Alternatively, the conductive shells 166, 168 may be die cast or stamped and formed from a metal material. In other various embodiments, the contact holder 160 may be provided without the conductive shells 166, 168. For example, rather than using the conductive shells 166, 168, the contact module 122 may include ground shields attached to the dielectric frame 170 to provide electrical shielding for the adapter signal contacts 162. In other various embodiments, the contact module 122 may be provided without shielding.

In an exemplary embodiment, the contact module 122 includes a first ground shield 172 configured to be coupled to the first conductive shell 166 and a second ground shield 174 configured to be coupled to the second conductive shell 168. The ground shields 172, 174 include the adapter ground contacts 164. In alternative embodiments, rather than mounting a plurality of the adapter ground contacts 164 to the conductive shells 166, 168 together as a unit with the ground shields 172, 174, individual adapter ground contacts 164 may be provided and separately coupled to the conductive shells 166, 168. The first ground shield 172 includes a main body 176 mounted to the side of the first conductive shell 166 and the second ground shield 174 includes a main body 178 mounted to the side of the second conductive shell 168. The first ground shield 172 includes first mating beams 180 extending from the main body 176 toward the first mating end of the contact module 122 and second mating beams 182 extending from the main body 176 toward the second mating end of the contact module 122. Similarly, the second ground shield 174 includes first mating beams 184 extending from the main body 178 toward the first mating end of the contact module 122 and a second mating beams 186 extending from the main body 178 toward the second mating end of the contact module 122. The mating beams 180, 182, 184, 186 define the adapter ground contacts 164 configured to be electrically connected to corresponding ground contacts of the first and second header connectors 102, 104, as described in further detail below.

The adapter signal contacts 162 extending between first and second mating ends 190, 192 at opposite ends of the contact module 122. The first and second mating ends 190, 192 are exposed beyond opposite ends of the contact holder 160. The first and second mating ends 190, 192 are configured to be received in corresponding signal channels 150 in the first and second receptacle housing 126, 128. The adapter signal contacts 162 include transition portions 194 (shown in phantom) between the first and second mating ends 190, 192. The transition portions 194 extend through the dielectric frame 170. In an exemplary embodiment, the transition portions 194 are embedded in the dielectric frame 170. In an exemplary embodiment, the adapter signal contacts 162 are stamped and formed from a metal plate and overmolded by the dielectric frame 170; however, the adapter signal contacts 162 may be manufactured and assembled by other processes in alternative embodiments. In an exemplary embodiment, the adapter signal contacts 162 include first receptacles 196 at the first mating ends 190 and second receptacles 198 at the second mating ends 192. The first and second receptacles 196, 198 are defined by opposing beams or paddles that are separated by a gap defining a socket configured to receive a mating contact. The beams may be deflectable and separated from each other when the mating contact is received in the gap. The first and second receptacles 196, 198 define female contacts configured to receive pin contacts of the first and second header connectors 102, 104, as described in further detail below. The first and second mating ends 190, 192 may have other types of contacts in alternative embodiments, such as male contacts, such as pin contacts.

Returning to FIGS. 3-5, when the contact modules 122 are assembled, the contact modules 122 may be arranged in the contact module stack 124 and loaded into corresponding pockets 136 in the first and second receptacle housings 126, 128. When assembled, the conductive shells 166, 168 are assembled around the dielectric frame 170. The ground shields 172, 174 are coupled to the conductive shells 166, 168 such that the adapter ground contacts 164 provide electrical shielding for the first and second mating ends 190, 192 of the adapter signal contacts 162. For example, the mating beams 180, 184 extend along both sides and above and below corresponding pairs of the mating ends 190 of the adapter signal contacts 162 and the mating beams 182, 186 extend along both sides and above and below corresponding pairs of the mating ends 192 of the adapter signal contacts 162. In an exemplary embodiment, the mating beams 180, 182, 184, 186 are arranged in column and in row with corresponding mating ends 190, 192 to provide electrical shielding for the adapter signal contacts 162.

In an exemplary embodiment, the conductive shells 166, 168, of the contact holder 160, include slots 200 at a top 202 and the bottom 204 of the contact module 122. The slots 200 in the contact modules 122 may be aligned when the contact modules 122 are arranged in the contact module stack 124. The slots 200 extend across the contact holder 160. The slots 200 are configured to receive a clip, as described in further detail below.

In an exemplary embodiment, the conductive shells 166, 168, of the contact holder 160, include latches 206 at the top 202 and the bottom 204. In the illustrated embodiment, latches 206 are provided at both ends of the contact holder 160; however, any number of latches 206 may be provided in alternative embodiments. The latches 206 are used to secure the contact modules 122 in the first and second receptacle housings 126, 128. For example, the latches 206 are received in corresponding openings 144 on the top 140 and the bottom 142 of the receptacle housings 126, 128. The latches 206 hold the contact modules 122 in the pockets 136.

In an exemplary embodiment, the mating adapter 110 includes a clip 210 configured to be coupled to the adapter housing 120 and/or the contact modules 122. The clip 210 is used to secure the mating adapter 110 in the corresponding header connector 102 or 104. Optionally, clips 210 may be provided on both sides of the mating adapter 110; however, in alternative embodiments, only one clip 210 is provided at one side of the mating adapter 110. In some embodiments, the clips 210 may be oriented to provide a semi-permanent attachment to both header connectors 102, 104 such as by orienting one of the clips 210 in one direction for connection to the first header connector 102 and orienting the other clip 210 in the opposite direction for connection to the second header connector 104.

The clip 210 includes a main body 212 defined by a plate and a locating beam 214 extending from the main body 212. The locating beam 214 is configured to be received in the slots 200 of the contact holder 160 to secure the clip 210 to the contact modules 122. In an exemplary embodiment, the clip 210 is reversible and may be coupled in two different orientations to change the direction of mating the mating adapter 110 with the first and second header connectors 102, 104. For example, FIG. 3 illustrates the clip 210 facing the second mating end 114 and FIG. 4 illustrates the clip 210 facing the first mating end 112. When assembled, the main body 212 may be oriented towards the first receptacle housing 126 (FIG. 3) or oriented towards the second receptacle housing 128 (FIG. 4). For example, the main body 212 may overlap one or more of the walls 130 of the corresponding receptacle housing 126 and/or 128. The main body 212 may engage one or more walls 130 of the corresponding receptacle housing 128 and/or 128. In an exemplary embodiment, the clip 210 includes one or more latches 216 configured to engage the corresponding header connector 102 or 104. In the illustrated embodiment, the latches 216 extend from the main body 212 proximate to the outer edges thereof. The latches 216 may be stamped from the main body 212 and bent. The latches 216 may be deflectable. Other types of securing features may be used in alternative embodiments. In the illustrated embodiment, the clip 210 includes a cutout 218 in the main body 212. The cutout is configured to be aligned with the keying feature 146 such that the clip 210 does not block the keying feature 146. In an exemplary embodiment, two clips 210 are provided configured to be coupled to the top and the bottom of the mating adapter 110.

Figure 7:
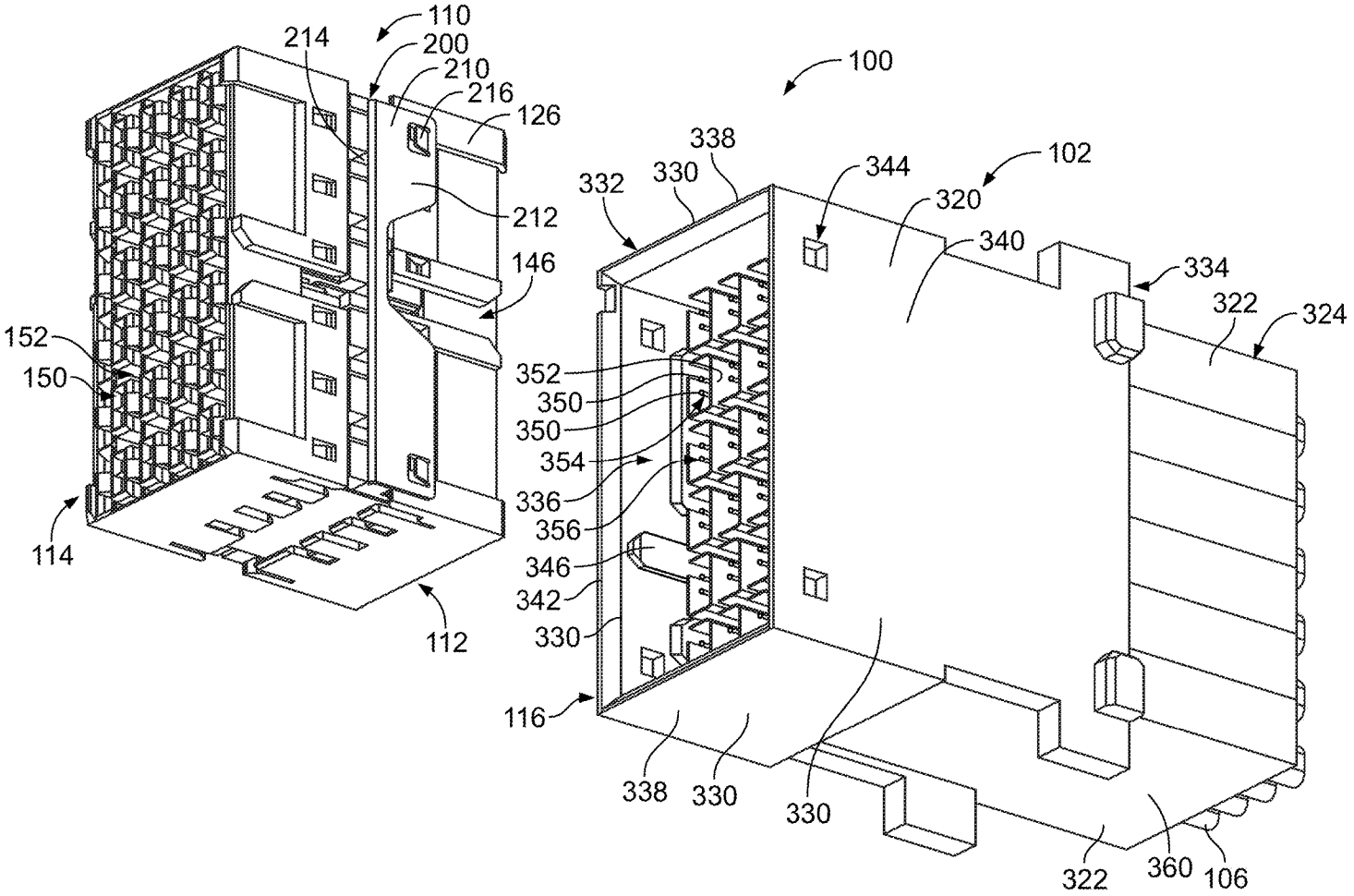
FIG. 7 is an exploded view of a portion of the electrical connector assembly showing the mating adapter poised for coupling to a cabled header connector.
Figure 8:
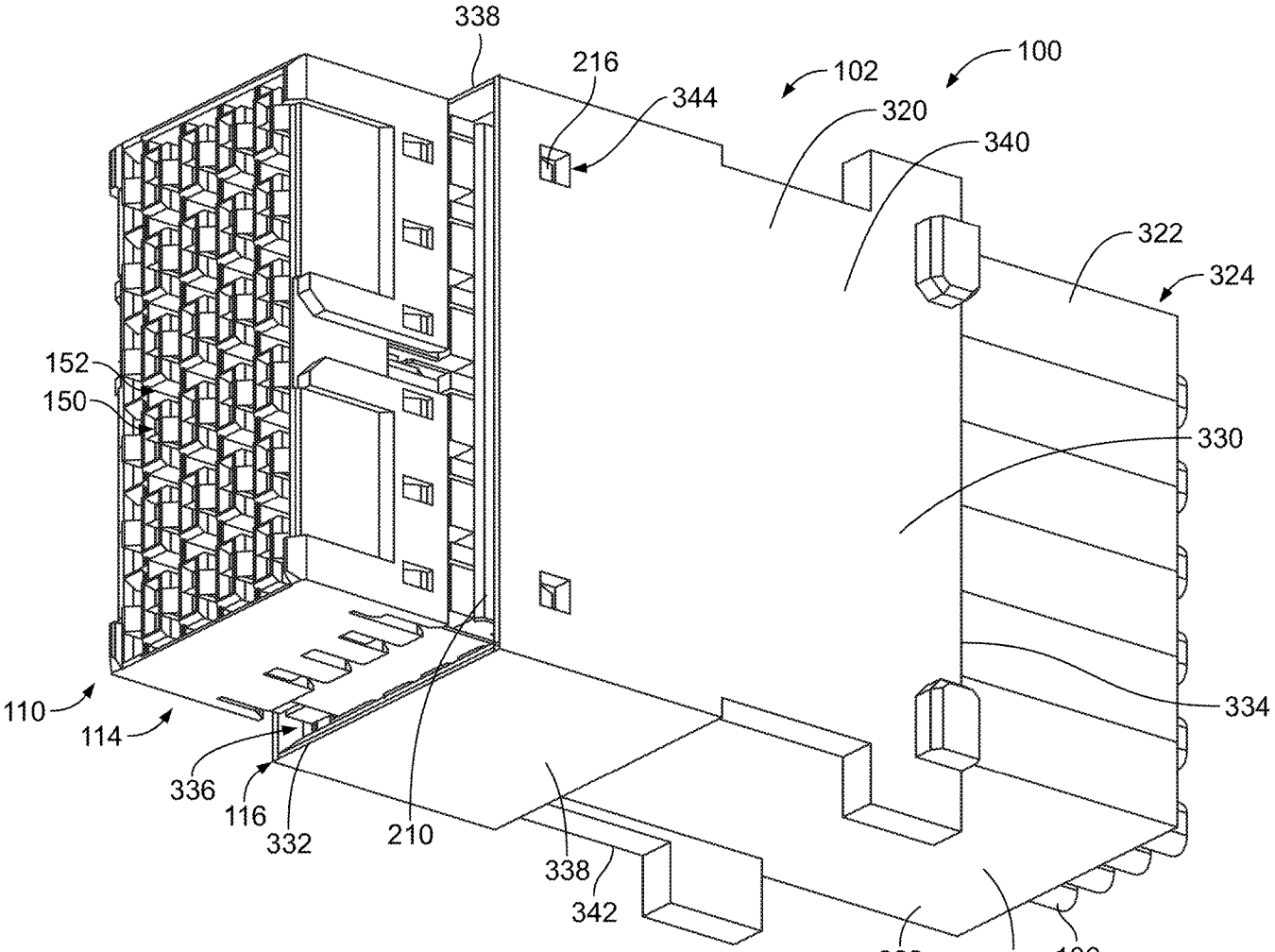
FIG. 8 is an assembled view of a portion of the electrical connector assembly showing the mating adapter coupled to the cabled header connector.

FIG. 7 is an exploded view of a portion of the electrical connector assembly 100 showing the mating adapter 110 poised for coupling to the first header connector 102. FIG. 8 is an assembled view of a portion of the electrical connector assembly 100 showing the mating adapter 110 coupled to the first header connector 102. In the illustrated embodiment, the clip 210 is coupled to the mating adapter 110 such that the locating beam 214 is received in the slots 200 with the main body 212 extending along the first receptacle housing 126. The first mating end 112 is configured to become semi-permanently attached to the first header connector 102 using the clip 210. For example, when the mating adapter 110 is loaded into the first header connector 102 the latches 216 engage the first header connector 102 to semi-permanently secure the mating adapter 110 to the first header connector 102. When the mating adapter 110 is semi-permanently attached to the first header connector 102 the mating adapter 110 and the first header connector 102 may be manipulated and moved together as a unit, such as for mating with the second header connector 104 (shown in FIG. 1). For example, the second mating end 114 of the mating adapter 110 is exposed beyond the first mating interface 116 and configured to be plugged into the second header connector 104.

During unmating from the second header connector 104, the mating adapter 110, being semi-permanently attached to the first header connector 102, may be separated from the second header connector 104 during the unmating process. The mating adapter 110 is semi-permanently attached to the first header connector 102 because the mating adapter 110 may be removed from the first header connector 102 using a removal tool to release the latches 216 of the clip 210 from the first header connector 102 to remove the mating adapter 110 for reuse or replacement without damaging the mating adapter 110 or the first header connector 102. However, because a tool is required to release the mating adapter 110 from the first header connector 102, the mating adapter 110 and the first header connector 102 remain semi-permanently attached during normal operation with the second mating end 114 of the mating adapter 110 finding the separable interface that is easily mated to and unmated from the second header connector 104 while remaining at attached to the first header connector 102.

In an exemplary embodiment, the first header connector 102 is a cable header connector having the cables 106 extending from the first header connector 102. The first header connector 102 includes a first header housing 320 holding a plurality of contact modules 322 arranged in a contact module stack 324. The cables 106 extend from the contact modules 322. The first header housing 320 includes a plurality of walls 330 extending between a first mating end 332 and a first terminating end 334. The walls 330 define a cavity 336 configured to receive the mating adapter 110, such as the first mating end 112 or the second mating end 114 of the mating adapter 110.

In the illustrated embodiment, the walls 330 define a rectangular header housing 320 having opposite sides 338, a top 340 and a bottom 342; however, the header housing 320 may have other shapes in alternative embodiments. In an exemplary embodiment, the header housing 320 includes openings 344 at the top 340 and the bottom 342. The openings 344 are configured to receive the latches 216 of the clip 210 to secure the mating adapter 110 in the cavity 336. In an exemplary embodiment, the header housing 320 includes one or more keying features 346 configured to engage corresponding keying features 146 of the mating adapter 110 to orient the mating adapter 110 in the cavity 336. In the illustrated embodiment, the keying features 346 are ribs along the top and the bottom of the cavity 336. The ribs may be offset for keyed mating of the mating adapter 110 with the header housing 320.

The first header connector 102 includes a plurality of first header signal contacts 350 held in the first header housing 320 and a plurality of first header ground contacts 352 held in the first header housing 320 providing electrical shielding for corresponding first header signal contacts 350. In the illustrated embodiment, the first header signal contacts 350 are arranged in pairs. The first header signal contacts 350 are male contacts having mating pins 354 at mating ends 356 of the header signal contacts 350. The first header ground contacts provide shielding between each of the pairs of first header signal contacts 350. For example, in the illustrated embodiment, the first header ground contacts 352 are U-shaped providing shielding on three sides of the corresponding first header signal contacts 350 with the fourth side being shielded by the adjacent header ground contact 352. The header ground contacts 352 may have other shapes in alternative embodiments.

In an exemplary embodiment, the header signal contacts 350 and the header ground contacts 352 are part of the contact modules 322. The contact modules 322 are coupled to the first header housing 320 at the terminating end 334 such that the header signal contacts 350 and the header ground contacts 352 extends into the cavity 336 of the header housing 320 for mating with the mating adapter 110. In an exemplary embodiment, each contact module 322 includes a contact holder 360 configured to hold the header signal contacts 350 and/or the header ground contacts 352. The contact holder 360 may be overmolded over portions of the header signal contacts 350 and/or the header ground contacts 352. The contact holder 360 may be overmolded over portions of the cables 106, which may be terminated to the header signal contacts 350 and/or the header ground contacts 352. The contact modules 322 may be manufactured by other processes other than overmolding in alternative embodiments.

When the mating adapter 110 is coupled to the first header connector 102, the first receptacle housing 126 and the clip 210 are loaded into the cavity 336. The keying features 146 interact with the keying features 346 to orient the mating adapter 110 in the cavity 336. The latches 216 on the clip 210 are received in corresponding openings 344 and the first header housing 320 to couple the mating adapter 110 to the first header connector 102. The first header signal contacts 350 are received in corresponding signal channels 150 for mating with corresponding adapter signal contacts 162 (shown in FIG. 6). The first header ground contacts 352 are received in corresponding ground channels 152 for mating with corresponding adapter ground contacts 164 (shown in FIG. 6).

Figure 9:
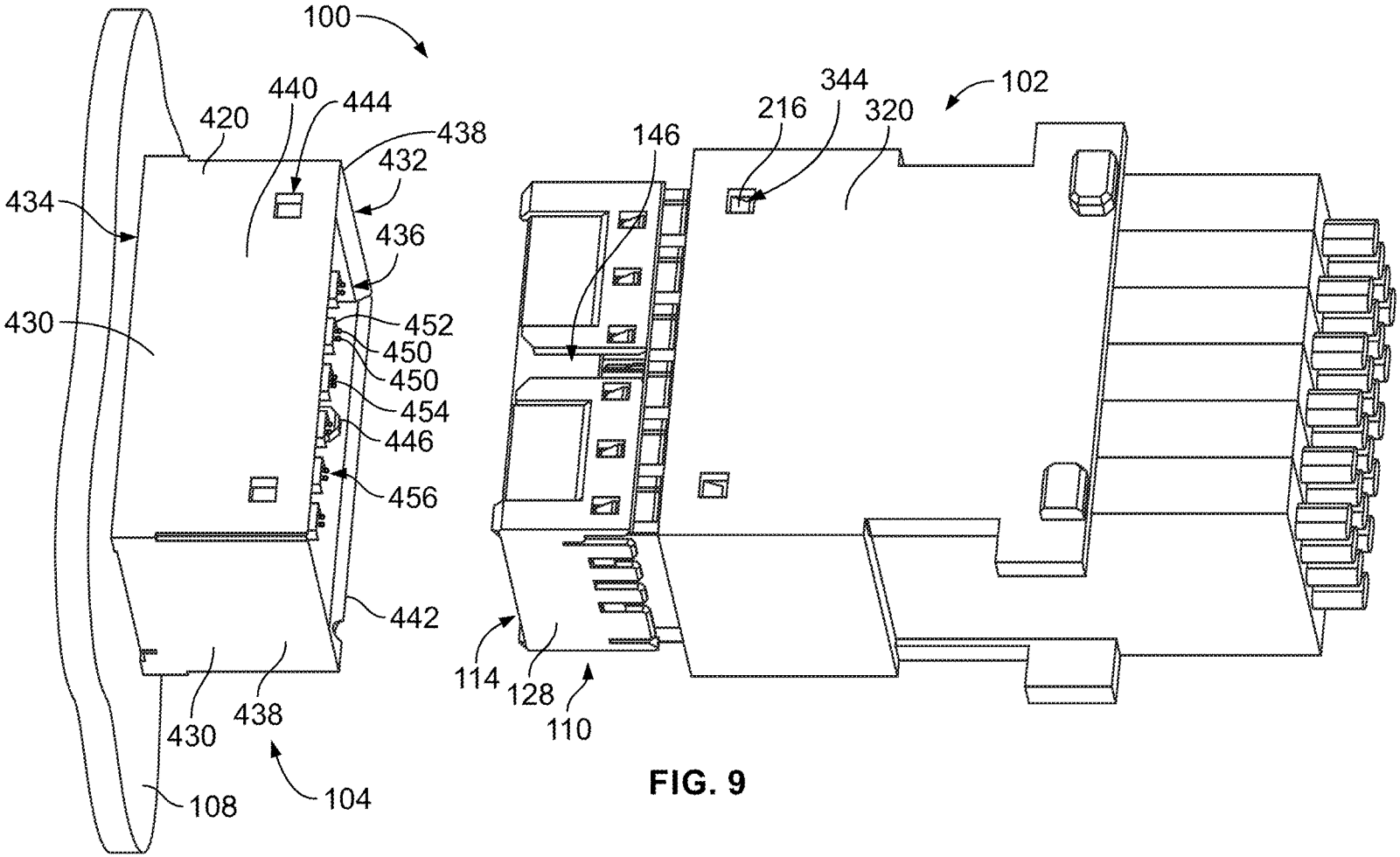
FIG. 9 is a perspective view of the electrical connector assembly showing the cabled header connector and the mating adapter poised for coupling to a board header connector.

FIG. 9 is a perspective view of the electrical connector assembly 100 showing the first header connector 102 and the mating adapter 110 poised for coupling to the second header connector 104. The mating adapter 110 is field installable and may be coupled to the first header connector 102 in the field to allow electrical connection of the first header connector 102 to the second header connector 104. The second mating end 114 of the mating adapter 110 extends beyond the end of the first header connector 102 for loading into the second header connector 104. For example, the second receptacle housing 128 is exposed beyond the first header connector 102 for loading into the second header connector 104. While the first header connector 102 defines a header interface and the second header connector 104 defines a header interface, using the mating adapter 110 on the first header connector 102 changes the mating interface of the assembly to allow the first header connector 102 to be electrically connected to the second header connector 104. For example, both the first and second header connectors 102, 104 may have male contacts while the mating adapter 110 may have female contacts at both ends thereof for mating with the first header connector 102 and the second header connector 104. The mating adapter 110 changes the gender of the contacts on the first header connector 102 to allow the first header connector 102 to mate with the second header connector 104.

While the electrical connector assembly 100 is illustrated with the mating adapter 110 being semi-permanently attached to the first header connector 102 for separable mating with the second header connector 104, it is realized that in alternative embodiments, the electrical connector assembly 100 may be arranged with the mating adapter 110 being semi-permanently attached to the second header connector 104 for separable mating with the first header connector 102.

The second header connector 104 includes a second header housing 420 mounted to the printed circuit board 108. The second header housing 420 includes a plurality of walls 430 extending between a second mating end 432 and a second terminating end 434 mounted to the printed circuit board 108. The walls 430 define a cavity 436 configured to receive the mating adapter 110, such as the second mating end 114 (or the first mating end 112 in other various embodiments) of the mating adapter 110.

In the illustrated embodiment, the walls 430 define a rectangular header housing 420 having opposite sides 438, a top 440 and a bottom 442; however, the header housing 420 may have other shapes in alternative embodiments. In an exemplary embodiment, the header housing 420 includes openings 444 at the top 440 and the bottom 442. The openings 444 are configured to receive the latches 216 of the clip 210 in various embodiments to secure the mating adapter 110 in the cavity 436; however, in the illustrated embodiment, the openings 444 do not receive the latches 216 as the latches 216 are received in the openings 344 in the first header housing 320. In an exemplary embodiment, the header housing 420 includes one or more keying features 446 configured to engage corresponding keying features 146 of the mating adapter 110 to orient the mating adapter 110 in the cavity 436. In the illustrated embodiment, the keying features 446 are ribs along the top and the bottom of the cavity 436. The ribs may be offset for keyed mating of the mating adapter 110 with the header housing 420.

The second header connector 104 includes a plurality of second header signal contacts 450 held in the second header housing 420 and a plurality of second header ground contacts 452 held in the second header housing 420 providing electrical shielding for corresponding second header signal contacts 450. In the illustrated embodiment, the second header signal contacts 450 are arranged in pairs. The second header signal contacts 450 are male contacts having mating pins 454 at mating ends 456 of the header signal contacts 450. The second header ground contacts provide shielding between each of the pairs of second header signal contacts 450. For example, in the illustrated embodiment, the second header ground contacts 452 are U-shaped providing shielding on three sides of the corresponding second header signal contacts 450 with the fourth side being shielded by the adjacent header ground contact 452. The header ground contacts 452 may have other shapes in alternative embodiments.

In an exemplary embodiment, the header signal contacts 450 and the header ground contacts 452 may extend through the terminating end 434 for termination to the printed circuit board 108. For example, the header signal contacts 450 and the header ground contacts 452 may include compliant pins, such as eye-of-the-needle contacts at the terminating ends thereof for termination to the printed circuit board 108. The header signal contacts 450 and the header ground contacts 452 may be terminated to the printed circuit board 108 by other means in alternative embodiments, such as soldering.

When the mating adapter 110 is coupled to the second header connector 104, the keying features 146 interact with the keying features 446 to orient the mating adapter 110 in the cavity 436. The second header signal contacts 450 are received in corresponding signal channels 150 (FIG. 8) for mating with corresponding adapter signal contacts 162 (shown in FIG. 6). The second header ground contacts 452 are received in corresponding ground channels 152 (FIG. 8) for mating with corresponding adapter ground contacts 164 (shown in FIG. 6). The mating adapter 110 is non-permanently attached to the second header connector 104, but rather is easily separable from the second header connector 104 during the unmating process by simply pulling the first header connector 102 away from the second header connector 104.

Figure 10:
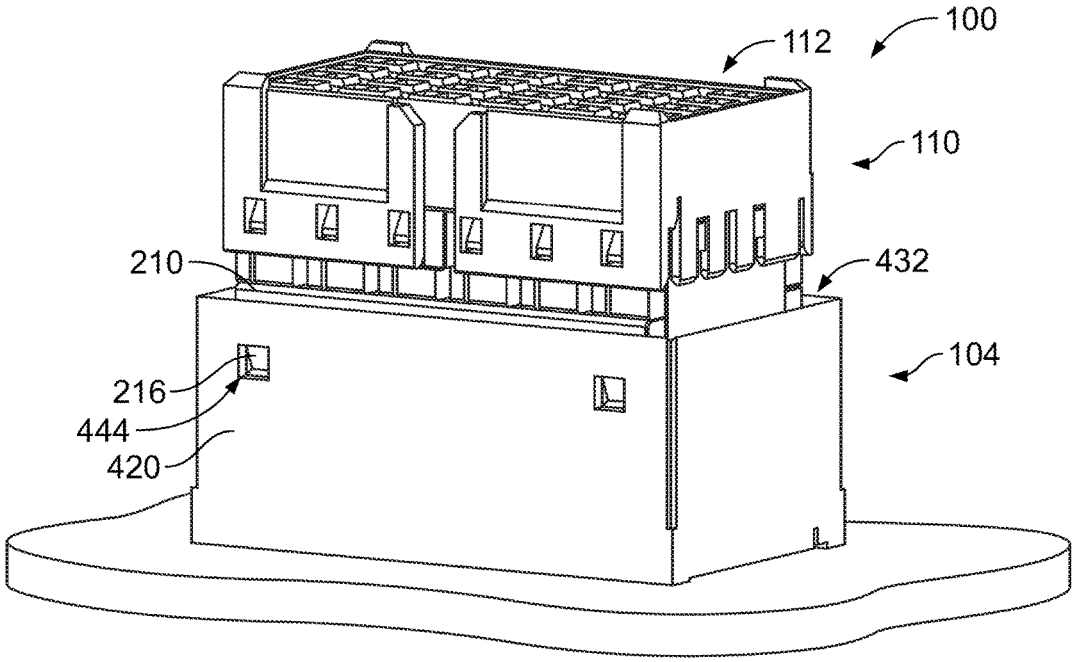
FIG. 10 is a perspective view of a portion of the electrical connector assembly showing the mating adapter coupled to a board header connector.

FIG. 10 is a perspective view of a portion of the electrical connector assembly 100 showing the mating adapter 110 semi-permanently coupled to the second header connector 104. In the illustrated embodiment, the clip 210 is coupled to the second mating end 114 (FIG. 8) of the mating adapter 110, which is loaded into the second header connector 104 and latchably coupled thereto. For example, the latches 216 of the clip 210 are received in corresponding openings 444 in the second header housing 420. The first mating end 112 of the mating adapter 110 extends beyond the mating end 432 of the second header housing 420 for coupling to the first header connector 102 (shown in FIG. 9) or another type of header connector, such as a board header connector. The first mating end 112 of the mating adapter 110 defines a separable interface that may be easily separated from the first header connector 102 as the clip 210 and the latches 216 are used to semi-permanently secure the mating adapter 110 to the second header connector 104 and no corresponding clip is used to semi-permanently attach the mating adapter 110 to the first header connector 102.

Using the mating adapter 110 on the second header connector 104 changes the mating interface of the assembly to allow the second header connector 104 to be electrically connected to the first header connector 102. For example, both the first and second header connectors 102, 104 may have male contacts while the mating adapter 110 may have female contacts at both ends thereof for mating with the first header connector 102 and the second header connector 104. The mating adapter 110 changes the gender of the contacts on the second header connector 104 to allow the second header connector 104 to mate with the first header connector 102.

In other various embodiments, rather than attaching the clip 210 to the second mating end 114, the mating adapter 110 may remain as shown in FIG. 7 with the clip 210 attached to the first mating end 112 and the first mating end 112 and the clip 210 a be loaded into the second header connector 104 leaving the second mating end 114 exposed beyond the second header connector 104 for mating with the first header connector 102. For example, in an exemplary embodiment, both mating ends 112, 114 of the mating adapter 110 may be identical such that either of the mating ends 112, 114 may be loaded into the second header connector 104 and either of the mating ends 112, 114 may be loaded into the first header connector 102.

Figure 11:
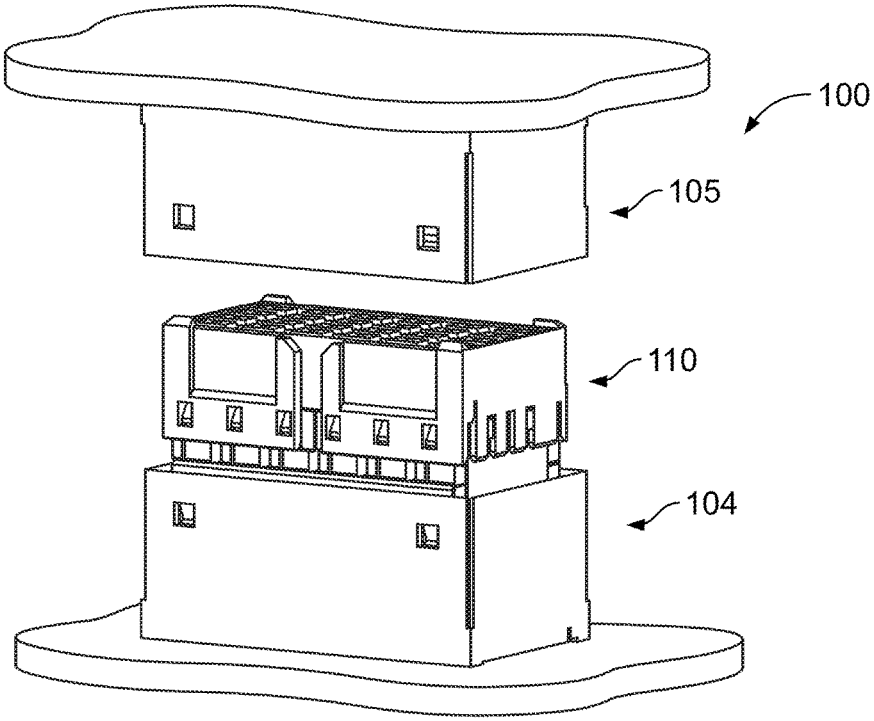
FIG. 11 is a perspective view of a portion of the electrical connector assembly showing the mating adapter for electrically connecting header connectors.

FIG. 11 is a perspective view of a portion of the electrical connector assembly 100 showing the mating adapter 110 being used to electrically connect two board header connectors. The mating adapter 110 is semi-permanently coupled to the second header connector 104 and a third header connector 105 is poised for coupling to the mating adapter 110. The third header connector 105 may be identical to the second header connector 104. In other various embodiments, rather than using the mating adapter 110 between two board header connectors, the mating adapter 110 may be used between two cable header connectors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembly comprising:

a header connector having a header housing including shroud walls defining a cavity, the header housing having a mating end and a terminating end, the header housing having a latching feature, the header connector including header signal contacts held in the header housing and header ground contacts held in the header housing providing electrical shielding for corresponding header signal contacts, the header signal contacts having mating pins at mating ends thereof; and a mating adapter having a first mating end and a second mating end, the mating adapter having an adapter housing holding at least one contact module extending between the first mating end and the second mating end, the at least one contact module each having a contact holder holding adapter signal contacts and adapter ground contacts, the adapter ground contacts including first mating beams at the first mating end and second mating beams at the second mating end for mating with corresponding header ground contacts of the header connector, the adapter ground contacts providing electrical shielding for corresponding adapter signal contacts, the adapter signal contacts having first receptacles at first ends thereof and second receptacles at second ends thereof, the mating adapter having a latching feature configured to be latchably coupled to the latching feature of the header housing to secure the mating adapter in the cavity of the header housing;

wherein the first mating end and the second mating end are configured to be selectively received in the cavity of the header housing, wherein the first receptacles are mated to the corresponding mating pins when the first mating end is received in the cavity of the header housing and wherein the second receptacles are mated to the corresponding mating pins when the second mating end is received in the cavity of the header housing.

2. The electrical connector assembly of claim 1, wherein the adapter housing includes a first receptacle housing at the first mating end and a second receptacle housing at the second mating end, the first receptacle housing being interchangeable with the second receptacle housing in the adapter housing.

3. The electrical connector assembly of claim 1, wherein the mating adapter comprises:

a first receptacle housing forming part of the adapter housing, the first receptacle housing having walls extending between a front and a rear of the first receptacle housing, the first receptacle housing having at least one pocket at the rear receiving a corresponding contact module, the first receptacle housing having signal channels at the front receiving corresponding first receptacles and the first receptacle housing having ground channels at the front receiving corresponding first mating beams; and a second receptacle housing forming part of the adapter housing, the second receptacle housing having walls extending between a front and a rear of the second receptacle housing, the rear of the second receptacle housing facing the rear of the first receptacle housing, the second receptacle housing having at least one pocket at the rear receiving a corresponding contact module, the second receptacle housing having signal channels at the front receiving corresponding second receptacles and the second receptacle housing having ground channels at the front receiving corresponding second mating beams;

wherein the first receptacle housing and the second receptacle housing are configured to be selectively received in the cavity of the header housing for mating the adapter signal contacts and the adapter ground contacts with the header signal contacts and the header ground contacts.

4. The electrical connector assembly of claim 1, wherein the mating adapter includes a clip coupled to the adapter housing, the clip comprising the latching feature for latchably coupling the mating adapter to the latching feature of the header housing.

5. The electrical connector assembly of claim 4, wherein the clip is reversibly coupled to the adapter housing to change the mating orientation of the mating adapter with respect to the header connector.

6. The electrical connector assembly of claim 1, wherein the mating adapter is selectively coupled to the header connector in one of a first orientation and a second orientation, in the first orientation, the first mating end being semi-permanently coupled to the header connector by the latching feature of the mating adapter being secured to the latching feature of the header connector and the second mating end being configured to be separably coupled to a second header connector, and in the second orientation, the second mating end being semi-permanently coupled to the header connector by the latching feature of the mating adapter being secured to the latching feature of the header connector and the first mating end being configured to be separably coupled to the second header connector.

7. The electrical connector assembly of claim 1, wherein the header connector includes at least one contact module received in the header housing at the terminating end, the at least one contact module including the header signal contacts and the header ground contacts, the header signal contacts being terminated to cables extending from the header connector opposite the header housing.

8. The electrical connector assembly of claim 1, wherein the header housing is configured to be mounted to a printed circuit board at the terminating end, the header signal contacts and the header ground contacts being terminated to the printed circuit board.

9. The electrical connector assembly of claim 1, wherein the second receptacles are configured to be mated to a second header connector when the first mating end of the mating adapter is received in the cavity of the header connector to electrically connect the second header connector to the header connector, and wherein the first receptacles are configured to be mated to the second header connector when the second mating end of the mating adapter is received in the cavity of the header connector to electrically connect the second header connector to the header connector.

10. A mating adapter for a header connector of an electrical connector assembly comprising:

contact modules arranged in a contact module stack and extending between a first mating end and a second mating end, each contact module having a contact holder holding adapter signal contacts and adapter ground contacts, the adapter signal contacts having first receptacles at the first mating end and second receptacles at the second mating end for mating with header signal contacts of the header connector, the adapter ground contacts including first mating beams at the first mating end and second mating beams at the second mating end for mating with header ground contacts of the header connector;

a first receptacle housing having walls extending between a front and a rear of the first receptacle housing, the first receptacle housing having pockets at the rear receiving the first mating ends of corresponding contact modules, the first receptacle housing having signal channels at the front receiving corresponding first receptacles and the first receptacle housing having ground channels at the front receiving corresponding first mating beams; and a second receptacle housing having walls extending between a front and a rear of the second receptacle housing, the second receptacle housing having pockets at the rear receiving the second mating ends of corresponding contact modules, the second receptacle housing having signal channels at the front receiving corresponding second receptacles and the second receptacle housing having ground channels at the front receiving corresponding second mating beams;

wherein the first receptacle housing and the second receptacle housing are configured to be received in the cavity of the header housing for mating the adapter signal contacts and the adapter ground contacts with the header signal contacts and the header ground contacts.

11. The mating adapter of claim 10, further comprising a clip configured to be coupled to the contact modules, the clip comprising a latching feature for latchably coupling the mating adapter to the header housing.

12. The mating adapter of claim 11, wherein the clip is reversibly coupled to the contact modules to change the mating orientation of the mating adapter with respect to the header connector.

13. The mating adapter of claim 10, wherein the first receptacle housing and the second receptacle housing are selectively coupled to the header housing in one of a first orientation and a second orientation, in the first orientation, the first mating end being semi-permanently coupled to the header housing by a latching feature being secured to a latching feature of the header housing and the second mating end being configured to be separably coupled to a second header connector, and in the second orientation, the second mating end being semi-permanently coupled to the header housing by the latching feature being secured to the latching feature of the header connector and the first mating end being configured to be separably coupled to the second header connector.

14. An electrical connector assembly comprising:

a first header connector having a first header housing including shroud walls defining a cavity, the first header housing having a first mating end and a first terminating end, the first header housing having a first latching feature, the first header connector including first header signal contacts held in the first header housing and first header ground contacts held in the first header housing providing electrical shielding for corresponding first header signal contacts, the first header signal contacts having mating pins at mating ends thereof, wherein the first header signal contacts and the first header ground contacts define a first mating interface;

a second header connector having a second header housing including shroud walls defining a cavity, the second header housing having a second mating end and a second terminating end, the second header housing having a second latching feature, the second header connector including second header signal contacts held in the second header housing and second header ground contacts held in the second header housing providing electrical shielding for corresponding second header signal contacts, the second header signal contacts having mating pins at mating ends thereof, wherein the second header signal contacts and the second header ground contacts define a second mating interface identical to the first mating interface; and a mating adapter having a first mating end and a second mating end, the mating adapter having an adapter housing holding at least one contact module extending between the first mating end and the second mating end, the at least one contact module each having a contact holder holding adapter signal contacts and adapter ground contacts, the adapter ground contacts including first mating beams at the first mating end and second mating beams at the second mating end for mating with corresponding header ground contacts of the header connector, the adapter ground contacts providing electrical shielding for corresponding adapter signal contacts, the adapter signal contacts having first receptacles at first ends thereof and second receptacles at second ends thereof, the mating adapter having an adapter latching feature configured to be latchably secured to at least one of the first latching feature and the second latching feature, wherein the first mating end and the second mating end are identical;

wherein the first mating end is received in the cavity of the first header housing such that the first receptacles are mated to the corresponding mating pins of the first header signal contacts and the adapter ground contacts are mated to the corresponding first header ground contacts; and wherein the second mating end is received in the cavity of the second header housing such that the second receptacles are mated to the corresponding mating pins of the second header signal contacts and the adapter ground contacts are mated to the corresponding second header ground contacts.

15. The electrical connector assembly of claim 14, wherein the adapter housing includes a first receptacle housing at the first mating end and a second receptacle housing at the second mating end, the first receptacle housing being substantially similar to the second receptacle housing for selective mating with the adapter housing.

16. The electrical connector assembly of claim 14, wherein the mating adapter comprises:

a first receptacle housing forming part of the adapter housing, the first receptacle housing having walls extending between a front and a rear of the first receptacle housing, the first receptacle housing having at least one pocket at the rear receiving a corresponding contact module, the first receptacle housing having signal channels at the front receiving corresponding first receptacles and the first receptacle housing having ground channels at the front receiving corresponding first mating beams; and a second receptacle housing forming part of the adapter housing, the second receptacle housing having walls extending between a front and a rear of the second receptacle housing, the rear of the second receptacle housing facing the rear of the first receptacle housing, the second receptacle housing having at least one pocket at the rear receiving a corresponding contact module, the second receptacle housing having signal channels at the front receiving corresponding second receptacles and the second receptacle housing having ground channels at the front receiving corresponding second mating beams;

wherein the first receptacle housing is received in the cavity of the first header housing and the second receptacle housing is received in the cavity of the second header housing for mating the adapter signal contacts with the first and second header signal contacts and for mating the adapter ground contacts with the first and second header ground contacts.

17. The electrical connector assembly of claim 14, wherein the mating adapter includes a clip coupled to the adapter housing in a first orientation, the clip comprising the latching feature for latchably coupling the mating adapter to the first latching feature of the first header housing in the first orientation.

18. The electrical connector assembly of claim 17, wherein the clip is reversibly coupled to the adapter housing to change the mating orientation of the clip between the first orientation and a second orientation, the latching feature latchably coupled to the second latching feature of the second header housing in the second orientation.

19. The electrical connector assembly of claim 14, wherein the first header connector includes contact modules received in the first header housing at the terminating end, the contact modules including the first header signal contacts and the first header ground contacts, the first header signal contacts being terminated to cables extending from the first header connector opposite the first header housing.

20. The electrical connector assembly of claim 14, wherein the first header housing is configured to be mounted to a printed circuit board at the terminating end, the first header signal contacts and the first header ground contacts being terminated to the printed circuit board.

* * * * *